US011189422B2

(12) United States Patent
Sawa et al.

(10) Patent No.: US 11,189,422 B2
(45) Date of Patent: Nov. 30, 2021

(54) IGNITION COIL

(71) Applicant: DIAMOND ELECTRIC MFG. CO., LTD., Osaka (JP)

(72) Inventors: Atsushi Sawa, Osaka (JP); Hiroshi Morita, Osaka (JP)

(73) Assignee: DIAMOND ELECTRIC MFG. CO., LTD., Osaka (JP)

( * ) Notice: Subject to any disclaimer, the term of this patent is extended or adjusted under 35 U.S.C. 154(b) by 107 days.

(21) Appl. No.: 16/722,690

(22) Filed: Dec. 20, 2019

(65) Prior Publication Data

US 2020/0219650 A1 Jul. 9, 2020

(30) Foreign Application Priority Data

Jan. 9, 2019 (JP) ..... JP2019-001637

(51) Int. Cl.

| | |
|---|---|
| ***H01F 38/12*** | (2006.01) |
| ***H01F 27/33*** | (2006.01) |
| ***H01T 13/41*** | (2006.01) |
| ***F02P 13/00*** | (2006.01) |
| ***H01F 27/02*** | (2006.01) |
| ***H01T 13/05*** | (2006.01) |

(52) U.S. Cl.

CPC ..... *H01F 38/12* (2013.01); *F02P 13/00* (2013.01); *H01F 27/022* (2013.01); *H01F 27/33* (2013.01); *H01T 13/05* (2013.01); *H01T 13/41* (2013.01)

(58) Field of Classification Search

CPC ..... H01F 38/12; H01F 27/022; H01F 27/33; F02P 13/00; H01T 13/05; H01T 13/41

See application file for complete search history.

(56) References Cited

U.S. PATENT DOCUMENTS

2018/0342347 A1* 11/2018 Ide ..... H01F 27/33

FOREIGN PATENT DOCUMENTS

JP 2017-98462 A 6/2017

* cited by examiner

*Primary Examiner* — Jacob M Amick

(74) *Attorney, Agent, or Firm* — Birch, Stewart, Kolasch & Birch, LLP

(57) ABSTRACT

This ignition coil includes: a bar-shaped resistor electrically connected to a terminal of a coil assembly via a relay; a case for storing these; and a filler filling gaps inside the case. The case includes a body, a cylindrical output portion protruding from the body, and an annular holding portion protruding inward from an inner circumferential surface of the output portion and formed integrally with the output portion. A part of the resistor is inserted into the holding portion, and thus a first internal area located on the body side with respect to the holding portion and shut off from outside is formed in an internal area of the output portion. The filler fills the first internal area.

15 Claims, 6 Drawing Sheets

IGNITION COIL

This application claims priority on Patent Application No. 2019-001637 filed in JAPAN on Jan. 9, 2019. The entire contents of this Japanese Patent Application are hereby incorporated by reference.

BACKGROUND OF THE INVENTION

Field of the Invention

The present invention relates to ignition coils of internal combustion engines.

Description of the Related Art

An ignition coil includes a coil assembly that generates a high voltage, therein. The high voltage from the coil assembly is applied to a spark plug provided in a combustion chamber of an internal combustion engine. By the voltage application, a spark due to discharge from the spark plug occurs to ignite fuel in the internal combustion engine.

The discharge at the spark plug can cause electric noise (conduction noise/radiation noise). When the noise reaches a surrounding circuit of a control device or the like, an erroneous operation of the circuit may occur. In order to prevent such an erroneous operation due to the noise, an ignition coil having a resistor mounted therein is in practical use. In this ignition coil, an output terminal of a coil assembly is connected to one end of the resistor, and the other end of the resistor is connected to the spark plug. A high voltage from the coil assembly is applied to the spark plug via the resistor. The resistor reduces electric noise due to discharge at the spark plug. An ignition coil having a resistor therein is disclosed in Japanese Laid-Open Patent Publication No. 2017-98462.

As described above, one end of the resistor is connected to the output end of the coil assembly, and the other end thereof is connected to the spark plug. The output voltage from the coil assembly is high, and therefore, when this voltage is applied, discharge can occur from one end to the other end of the resistor. When this discharge occurs, the resistor cannot serve the function of reducing electric noise. In the ignition coil described in Japanese Laid-Open Patent Publication No. 2017-98462, the resistor is held in a resistor storage portion by fixation means composed of a plurality of projections and holding means formed by an O ring or the like attached to the fixation means, whereby insulation resin is prevented from leaking out from the resistor storage portion. Thus, the periphery of the outer wall surface of the resistor is covered by the insulation resin, and discharge at the resistor is prevented. However, this structure is complicated, and components for the holding means are also needed. This hampers improvement in efficiency of assembling of the ignition coil, and can also cause increase in assembly cost.

An object of the present invention is to provide an ignition coil that prevents discharge at a resistor with a simple structure while suppressing increase of components.

SUMMARY OF THE INVENTION

An ignition coil for internal combustion engine according to the present invention includes: a coil assembly including a primary coil, a secondary coil, and a terminal that outputs a voltage from the secondary coil; a relay electrically connected to the terminal; a resistor having a bar shape and electrically connected to the relay; a case that stores the coil assembly, the relay, and the resistor; and a filler filling a gap inside the case. The case includes a body, an output portion having a cylindrical shape and protruding from the body, and a holding portion which has an annular shape and which protrudes inward from an inner circumferential surface of the output portion and extends in a circumferential direction of the inner circumferential surface, the holding portion being formed integrally with the output portion. A part of the resistor is inserted into the holding portion, and thus a first internal area located on a body side with respect to the holding portion and shut off from outside is formed in an internal area of the output portion. The filler fills the first internal area so as to cover a surface of the resistor.

In the ignition coil according to the present invention, the annular holding portion is formed on the inner circumferential surface of the output portion of the case. A part of the resistor is inserted into the holding portion, and thus the first internal area located on the body side with respect to the holding portion and shut off from outside is formed in the internal area of the output portion. The filler fills the first internal area so as to cover the surface of the resistor. That is, the part, of the resistor, that is on the body side with respect to the holding portion is located in the first internal area shut off from outside, and the surface of the part is covered by the filler. The part, of the resistor, that is on the side opposite to the body with respect to the holding portion is located outside the first internal area. This structure effectively prevents discharge from one end to the other end of the resistor. In this ignition coil, the resistor is inserted into the annular holding portion, whereby the resistor is attached to the output portion and the first internal area to which the filler is to be supplied is formed. This structure is simple. Further, the holding portion is formed as a part of the case and integrally with the output portion, and therefore components are not increased. In this ignition coil, discharge at the resistor is prevented with a simple structure while increase of components is suppressed.

Preferably, a second internal area located on a side opposite to the body with respect to the holding portion is further formed in the internal area of the output portion.

Preferably, an outer diameter of the first internal area is larger than an outer diameter of the second internal area.

Preferably, the resistor penetrates through the holding portion, and thus one end of the resistor is located in the second internal area.

Preferably, an outer diameter of the first internal area gradually decreases from the body side toward a holding portion side.

Preferably, a side surface, of the holding portion, that is on the body side is sloped in an inward direction from the body side toward a side opposite thereto.

Preferably, the relay is in contact with the resistor, in the first internal area.

Preferably, the relay has a connection portion that is in contact with a side surface of the resistor.

Preferably, the connection portion has a ring shape, and the resistor is inserted through an inner side of the connection portion. The connection portion may have a cap shape, and one end of the resistor is capped with the connection portion.

DESCRIPTION OF THE PREFERRED EMBODIMENTS

The following will describe in detail the present invention based on preferred embodiments with reference to the accompanying drawing.

Figure 1:
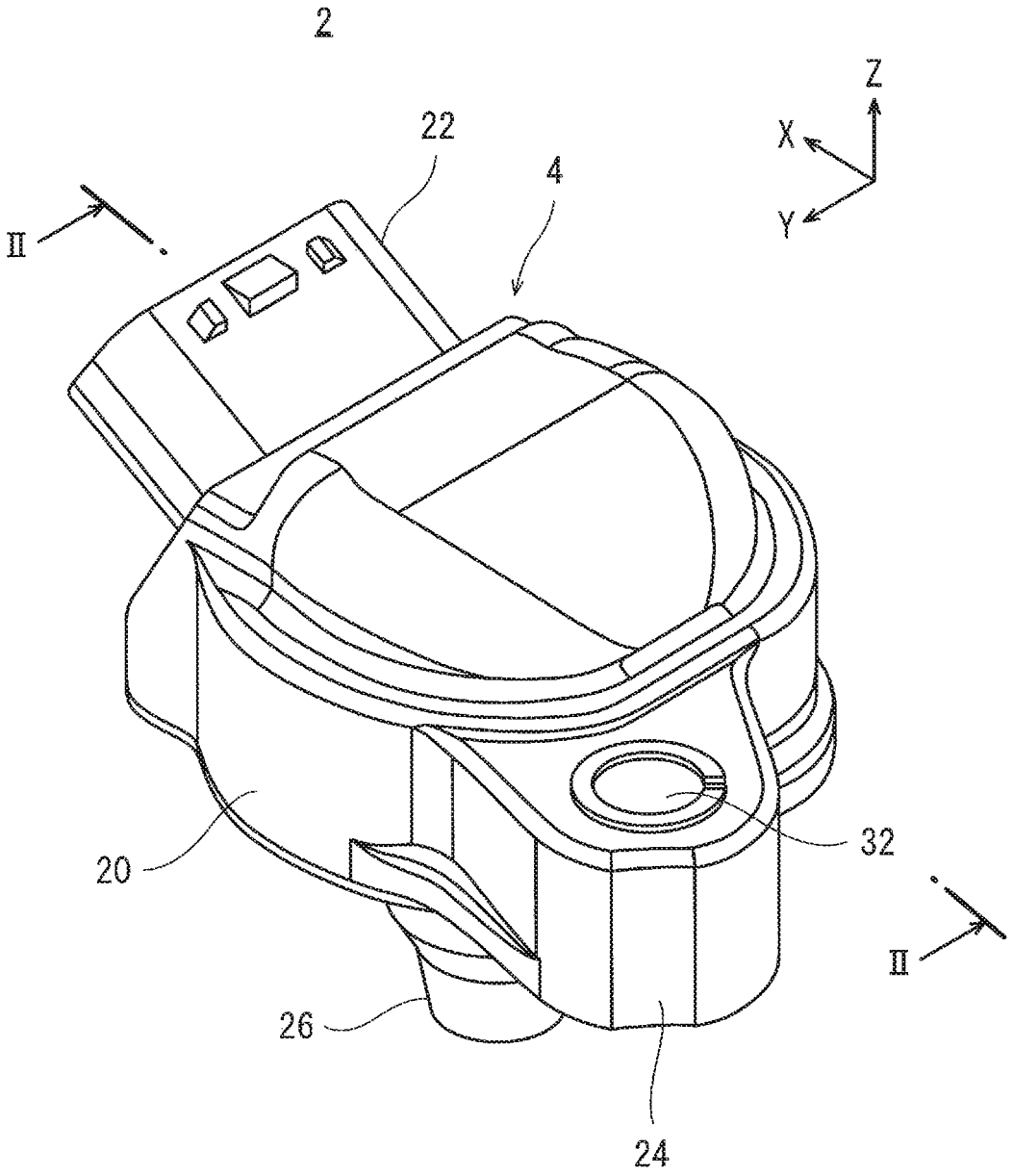
FIG. 1 is a perspective view of an ignition coil according to an embodiment of the present invention.
Figure 2:
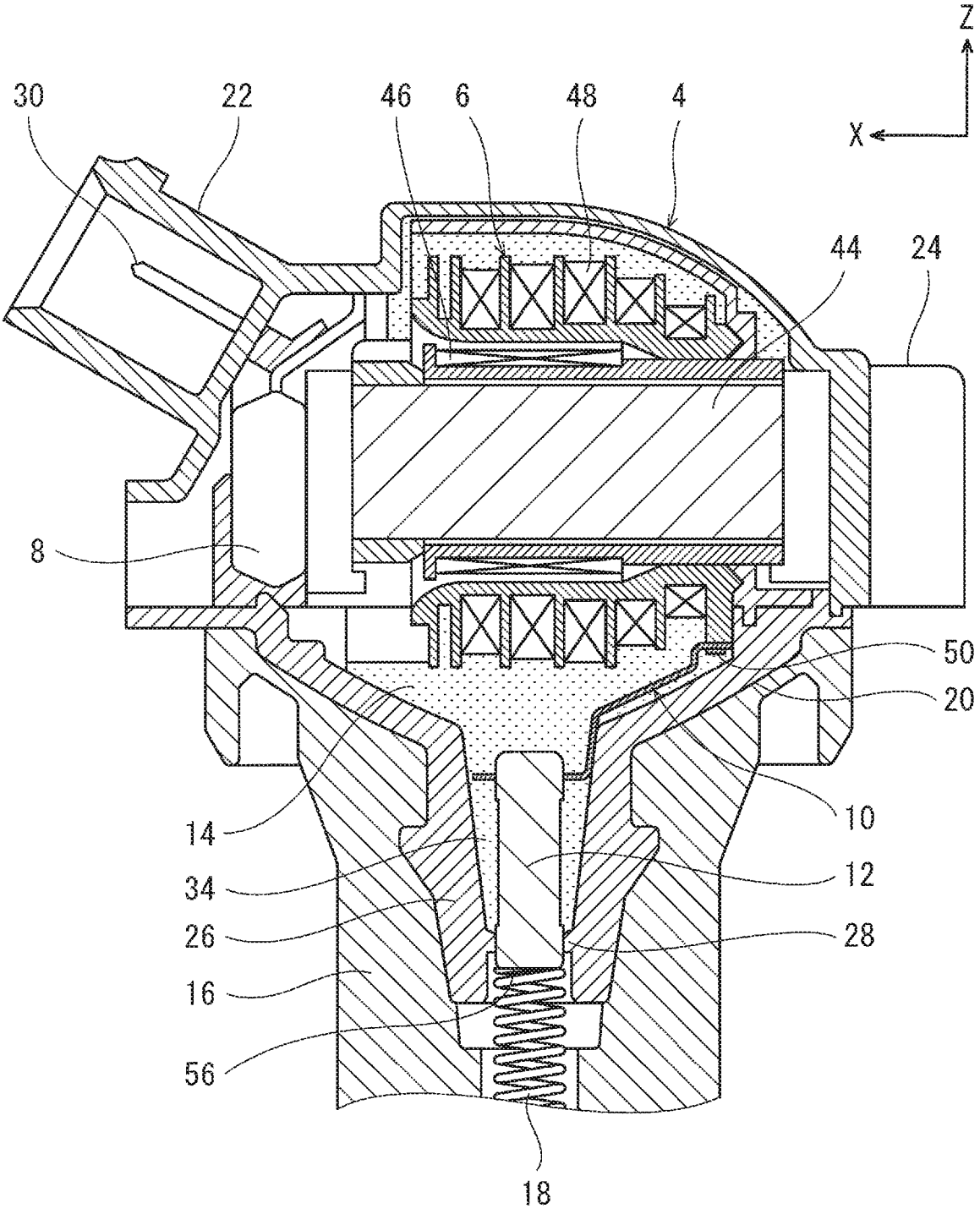
FIG. 2 is a sectional view of the ignition coil shown in FIG. 1, taken along line II-II.
Figure 3:
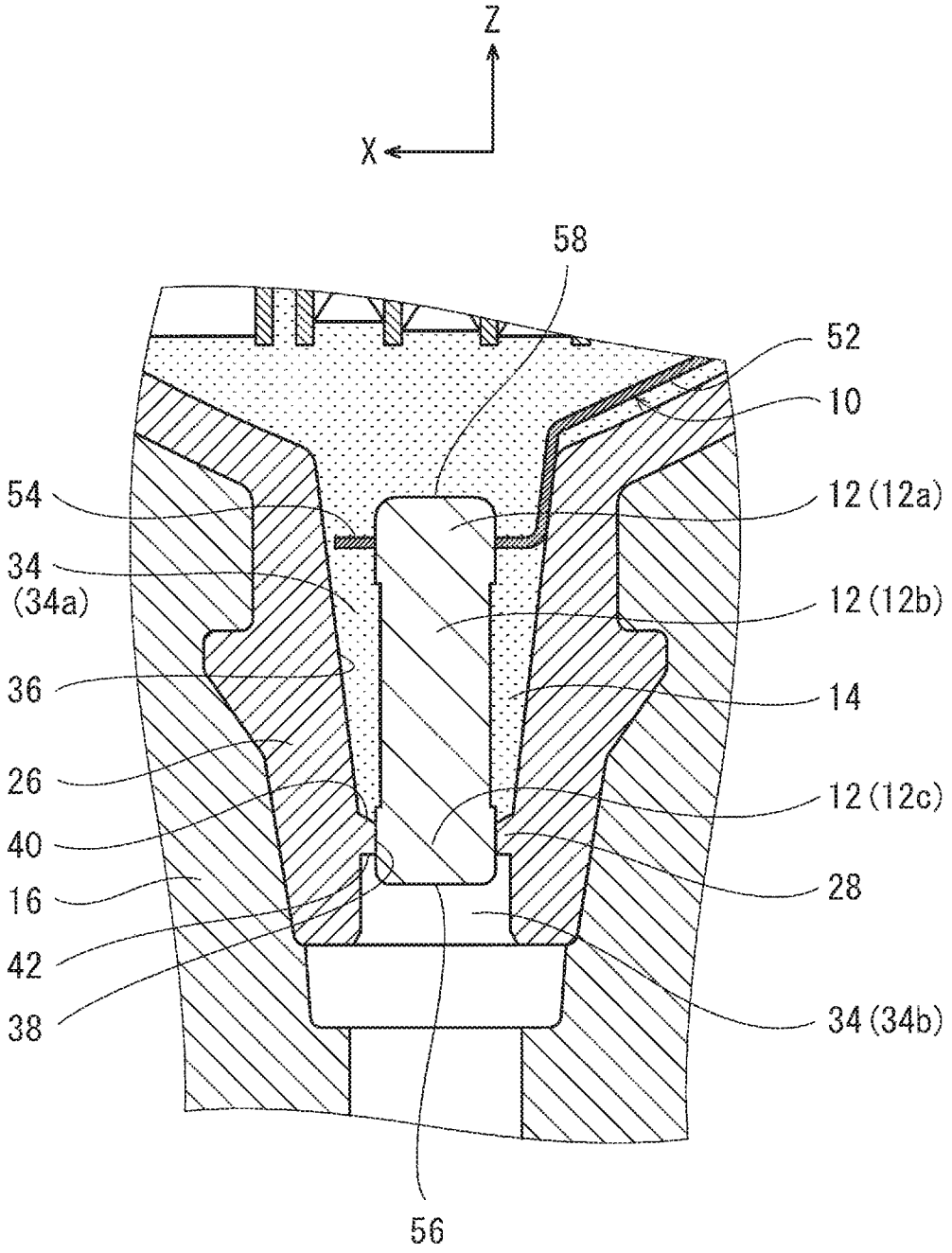
FIG. 3 is an enlarged sectional view of a part of FIG. 2.

FIG. 1 shows an ignition coil 2 according to an embodiment of the present invention. FIG. 2 is a sectional view of the ignition coil 2 shown in FIG. 1, taken along line II-II. FIG. 3 is an enlarged view of a part of FIG. 2. In FIGS. 1 to 3, an arrow X indicates a frontward direction of the ignition coil 2. The direction opposite thereto is a rearward direction. An arrow Y indicates a rightward direction of the ignition coil 2. The direction opposite thereto is a leftward direction. An arrow Z indicates an upward direction of the ignition coil 2. The direction opposite thereto is a downward direction. The ignition coil 2 includes a case 4, a coil assembly 6, an igniter 8, a relay 10, a resistor 12, and a filler 14. In FIG. 2, parts of a plug boot 16 and a spring 18 mounted to the ignition coil 2 are also shown together.

The case 4 forms an exterior of the ignition coil 2. The case 4 is hollow, and stores therein the coil assembly 6, the igniter 8, the relay 10, the resistor 12, and the filler 14. The case 4 is made from resin. Examples of preferable materials for the case 4 include polybutylene terephthalate (PBT), polyphenylene sulfide (PPS), and polyethylene terephthalate (PET). The case 4 includes a body 20, a connector portion 22, a flange portion 24, an output portion 26, and a holding portion 28.

The body 20 has a box shape and stores the coil assembly 6 and the igniter 8 therein. The connector portion 22 protrudes frontward from the body 20. The connector portion 22 has a cylindrical shape, and a connector terminal 30 is provided on the inner side thereof. When the ignition coil 2 is mounted to a vehicle, the connector terminal 30 is connected to a control device (ECU) of the vehicle. The flange portion 24 protrudes rearward from the body 20. The flange portion 24 has a hole 32 penetrating in the up-down direction. Although not shown, a bolt is inserted into the hole 32 and a hole provided in the internal combustion engine, whereby the ignition coil 2 is fixed to the internal combustion engine.

The output portion 26 protrudes downward from the body 20. In FIG. 3, the vicinity of the output portion 26 is shown in an enlarged manner. As shown in FIG. 3, the output portion 26 has a cylindrical shape extending downward from the body 20. A space surrounded by the inner circumferential surface 36 of the output portion 26 is referred to as "internal area 34" of the output portion 26. The output portion 26 has the internal area 34.

The holding portion 28 is located on the inner circumferential surface 36 of the output portion 26. The holding portion 28 protrudes inward from the inner circumferential surface 36 of the output portion 26. The holding portion 28 has an annular shape extending in the circumferential direction of the inner circumferential surface 36 of the output portion 26. The holding portion 28 has an inner circumferential surface 38, a first side surface 40 which is a side surface on the body 20 side (upper side), and a second side surface 42 which is a side surface on the side (lower side) opposite to the body 20. As shown in FIG. 3, in the present embodiment, the first side surface 40 is sloped downward relative to the perpendicular direction of the inner circumferential surface 36 of the output portion 26. The first side surface 40 is sloped in the inward direction from the body 20 side toward the side opposite thereto. The holding portion 28 is formed integrally with the output portion 26.

As shown in FIG. 2, the coil assembly 6 is stored in the body 20 of the case 4. The coil assembly 6 includes a core 44, a primary coil 46, a secondary coil 48, and an output terminal 50. The primary coil 46 is wound around the outer circumference of the core 44, and the secondary coil 48 is wound on the outer side thereof. The number of turns of a wire of the secondary coil 48 is significantly larger than the number of turns of a wire of the primary coil 46. For example, the number of turns of a wire of the primary coil 46 is about 100, and the number of turns of a wire of the secondary coil 48 is 8000 to 15000. Thus, when a current in the primary coil 46 is changed, a high voltage is generated on the secondary coil 48. For example, a voltage of several tens of kV is generated on the secondary coil 48. This high voltage is outputted from the output terminal 50 of the coil assembly 6.

As shown in FIG. 2, the igniter 8 is stored in the body 20 of the case 4. The igniter 8 is located frontward of the coil assembly 6. The igniter 8 is a switch for controlling conduction and interruption of the current of the primary coil 46 of the coil assembly 6.

The relay 10 extends from the inside of the body 20 of the case 4 to the inside of the output portion 26. The relay 10 is electrically connected to the output terminal 50 of the coil assembly 6, and is also electrically connected to the resistor 12. The output terminal 50 of the coil assembly 6 and the resistor 12 are electrically connected to each other via the relay 10. The relay 10 is made of a metal having excellent conductivity.

The resistor 12 is stored in the output portion 26 of the case 4. The resistor 12 has a bar shape. In the present embodiment, the resistor 12 has a columnar shape. The resistor 12 has an upper portion 12*a*, a middle portion 12*b*, and a lower portion 12*c*. The outer diameters of the upper portion 12*a* and the lower portion 12*c* are slightly larger than the outer diameter of the middle portion 12*b*. As shown in FIG. 2, when the ignition coil 2 is mounted to the internal combustion engine, an end surface 56 of the lower portion 12*c* of the resistor 12 comes into contact with the spring 18. Although not shown, the other end of the spring 18 is connected to a spark plug. The upper portion 12*a* of the resistor 12 is connected to the relay 10. The resistor 12 is in contact with the relay 10, in the internal area 34 of the output portion 26. The resistor 12 has such an appropriate electric resistance value and an appropriate inductance value that suppress electric noise (conduction noise/radiation noise) due to discharge at the spark plug.

Figure 4B:
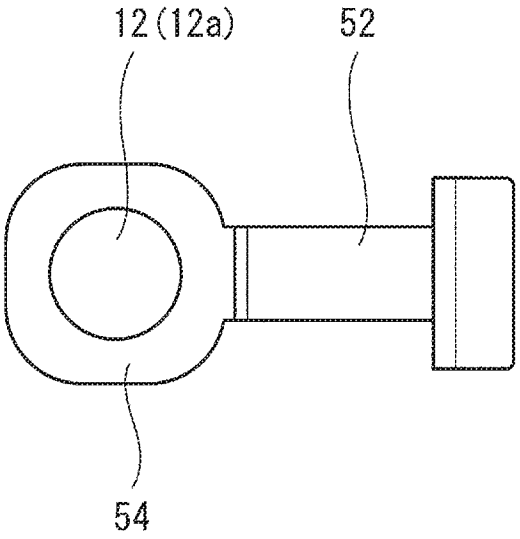
FIG. 4B is a plan view of the relay and the resistor.
Figure 4A:
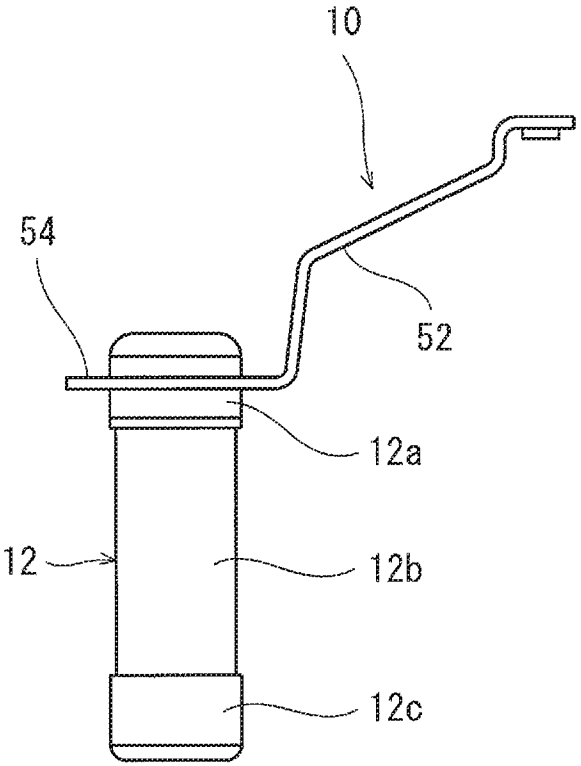
FIG. 4A is a side view showing a relay of the ignition coil shown in FIG. 2, together with a resistor.

FIG. 4A is a side view showing only the resistor 12 and the relay 10, and FIG. 4B is a plan view showing the resistor 12 and the relay 10. As shown in the drawings, the relay 10 has an arm 52 and a connection portion 54 connected to one end of the arm 52. The other end of the arm 52 is in contact with the output terminal 50 of the coil assembly 6. As shown in FIG. 4B, the connection portion 54 has a ring shape. As shown in FIG. 4A, the upper portion 12*a* of the resistor 12 is inserted through the connection portion 54. Thus, the connection portion 54 comes into contact with the side surface of the resistor 12.

In the present embodiment, the output terminal 50 of the coil assembly 6 and the arm 52 are formed as separate components. The output terminal 50 may be formed integrally with the arm 52. The output terminal 50 of the coil assembly 6, the arm 52, and the connection portion 54 may be formed integrally with one another.

As shown in FIG. 3, the lower portion 12*c* of the resistor 12 is inserted into the holding portion 28. Here, the side surface (outer circumferential surface) of the resistor 12 and the inner circumferential surface of the holding portion 28 are in contact with each other without gaps. Thus, the resistor 12 is fixed by the holding portion 28. By the resistor 12 being inserted into the holding portion 28, a first internal area 34*a* shut off from outside is formed in the internal area 34 of the output portion 26. The first internal area 34*a* is a part, of the internal area 34 of the output portion 26, that is located on the body 20 side (upper side) with respect to the holding portion 28. On the other hand, a part, of the internal area 34 of the output portion 26, that is located on the side (lower side) opposite to the body 20 with respect to the holding portion 28 is referred to as second internal area 34*b*.

As shown in FIG. 3, in the present embodiment, the lower portion 12*c* of the resistor 12 penetrates through the holding portion 28. The end of the lower portion 12*c* extends to the second internal area 34*b*. That is, one end of the resistor 12 is located in the first internal area 34*a*, and the other end thereof is located in the second internal area 34*b*. The contact part between the resistor 12 and the relay 10 is located in the first internal area 34*a*, and the contact part between the resistor 12 and the spring 18 is located in the second internal area 34*b*.

As shown in FIG. 3, in the present embodiment, the outer diameter of the first internal area 34*a* gradually decreases from the body 20 side toward the holding portion 28 side. In other words, the inner diameter of the output portion 26 gradually decreases from the body 20 side toward the holding portion 28 side. In addition, in the present embodiment, the outer diameter of the first internal area 34*a* is larger than the outer diameter of the second internal area 34*b*.

The filler 14 fills gaps formed inside the case 4 when the coil assembly 6, the igniter 8, the relay 10, and the resistor 12 are stored in the case 4. Typically, the filler 14 is made from thermosetting resin. As shown in FIG. 3, in the first internal area 34*a*, the filler 14 fills the area around the resistor 12 and the relay 10. The filler 14 covers a side surface of a part, of the resistor 12, that is located in the first internal area 34*a*, and an end surface 58 of the upper portion 12*a*. The filler 14 also covers the contact part between the resistor 12 and the relay 10. The filler 14 covers the entire outer surface of a part, of the resistor 12, that is on the body 20 side with respect to the holding portion 28, without gaps.

Operation of the ignition coil 2 is as follows. A control signal from a control device of a vehicle is sent to the igniter 8 via the connector terminal 30. In accordance with the control signal, the igniter 8 conducts a current of the primary coil 46 or interrupts the current. Due to change in the current of the primary coil 46, a high voltage is generated on the secondary coil 48. The high voltage generated on the secondary coil 48 is applied to the resistor 12 via the relay 10 from the output terminal 50 of the coil assembly 6, and then applied to the spark plug via the spring 18 from the resistor 12. A spark occurs from the spark plug, to ignite fuel.

The following will describe advantageous effects of the present invention.

In the ignition coil 2 according to the present invention, a part of the resistor 12 is inserted into the holding portion 28, and thus the first internal area 34*a* shut off from outside is formed in the internal area 34 of the output portion 26. The filler 14 fills the first internal area 34*a* so as to cover the surface of the resistor 12. That is, a part, of the resistor 12, that is on the body 20 side with respect to the holding portion 28 is located in the first internal area 34*a* shut off from outside, and the entire surface of the part is covered by the filler 14. The contact part between the resistor 12 and the relay 10 is also covered by the filler 14. On the other hand, the contact part between the resistor 12 and the spring 18 is located outside the first internal area 34*a*. The contact part between the resistor 12 and the relay 10 and the contact part between the resistor 12 and the spring 18 are isolated from each other by the filler 14 and the holding portion 28. This structure effectively prevents discharge between one end and the other end of the resistor 12. In this ignition coil 2, discharge at the resistor 12 is prevented. This resistor 12 effectively contributes to reduction in electric noise due to discharge at the spark plug. In this ignition coil 2, electric noise is effectively suppressed.

In this ignition coil 2, the bar-shaped resistor 12 is inserted into the annular-shaped holding portion 28, whereby the resistor 12 is attached to the output portion 26 and the first internal area 34*a* to which the filler 14 is to be supplied is formed. This structure is simple. This contributes to achievement of high assembly efficiency and reduction in assembly cost.

As described above, the holding portion 28 is formed integrally with the output portion 26. In this ignition coil 2, no special components are needed for fixing the resistor 12 and forming the first internal area 34*a* shut off from outside. In this ignition coil 2, components are not increased. In this ignition coil 2, assembly cost can be further reduced.

There is a method of suppressing discharge at the resistor 12 by increasing the size of the resistor 12. However, increasing the size of the resistor 12 can hamper size reduction and weight reduction of the ignition coil. In this ignition coil 2, it is not necessary to increase the size of the resistor 12, in order to suppress discharge at the resistor 12. This contributes to size reduction and weight reduction of the ignition coil 2. Further, since this ignition coil 2 has a simple structure, it is easy to reduce the size and the weight thereof. In this ignition coil 2, size reduction and weight reduction are achieved while discharge at the resistor 12 is prevented.

As described above, in the present embodiment, the outer diameter of the first internal area 34*a* of the output portion 26 gradually decreases from the body 20 side toward the holding portion 28 side. In manufacturing of the ignition coil 2, the filler 14 is supplied from the body 20 side to the first internal area 34*a*. Since the outer diameter of the first internal area 34*a* gradually decreases from the body 20 side toward the holding portion 28 side, it is possible to spread the filler 14 to every part of the first internal area 34*a*. The entire surface of a part, of the resistor 12, that is located in the first internal area 34*a* is covered by the filler 14 without gaps. This effectively prevents discharge at the resistor 12. In this ignition coil 2, electric noise due to discharge at the spark plug is effectively suppressed. Further, since the outer diameter of the first internal area 34*a* is large on the body 20 side, a certain degree of freedom in the shape of the relay 10 can be obtained.

As described above, in the present embodiment, the first side surface 40 of the holding portion 28 is sloped in the inward direction from the body 20 side toward the side opposite thereto. This enables the filler 14 to be supplied to the deepest part of the corner formed by a side surface of the resistor 12 and the first side surface 40, without gaps. The entire surface of a part, of the resistor 12, that is located in the first internal area 34*a* is covered by the filler 14 without gaps. This effectively prevents discharge at the resistor 12. In this ignition coil 2, electric noise due to discharge at the spark plug is effectively suppressed.

As described above, in the present embodiment, the inner diameter of the first internal area 34*a* is larger than the inner diameter of the second internal area 34*b*. In the first internal area 34*a*, the resistor 12 and the relay 10 are located. Since the inner diameter of the first internal area 34*a* is larger, the filler 14 readily flows into the first internal area 34*a* even though the resistor 12 and the relay 10 are located therein. The filler 14 can fill the inside of the first internal area 34*a* without gaps. This effectively prevents discharge at the resistor 12. In this ignition coil 2, electric noise due to discharge at the spark plug is effectively suppressed. Further, since the inner diameter of the first internal area 34*a* is larger, a certain degree of freedom in the shape of the relay 10 can be obtained.

As described above, in the present embodiment, in the internal area 34, the second internal area 34*b* is provided on the side opposite to the body 20 with respect to the holding portion 28. The end surface 56 of the lower portion 12*c* of the resistor 12 is located in the second internal area 34*b*. Thus, the contact part between the resistor 12 and the spring 18 can be located in the second internal area 34*b*. This effectively protects the contact part between the resistor 12 and the spring 18. In addition, since the lower portion 12*c* of the resistor 12 extends to the second internal area 34*b*, the resistor 12 and the spring 18 can be easily and reliably brought into contact with each other.

As described above, in the present embodiment, the contact part between the resistor 12 and the relay 10 is located in the first internal area 34*a*. Thus, the contact part between the resistor 12 and the relay 10 can be reliably covered by the filler 14 without gaps. This effectively prevents discharge at the resistor 12. In this ignition coil 2, electric noise due to discharge at the spark plug is effectively suppressed.

As described above, in the present embodiment, the connection portion 54 of the relay 10 has a ring shape, and the resistor 12 is inserted through the connection portion 54. The connection portion 54 is in contact with the side surface of the resistor 12. Thus, the relay 10 can be reliably fixed to the resistor 12, and the contact area between the connection portion 54 and the resistor 12 can be increased. Thus, the contact resistance between the relay 10 and the resistor 12 can be stably reduced. This effectively prevents discharge at the resistor 12. In this ignition coil 2, electric noise due to discharge at the spark plug is effectively suppressed.

Figure 5:
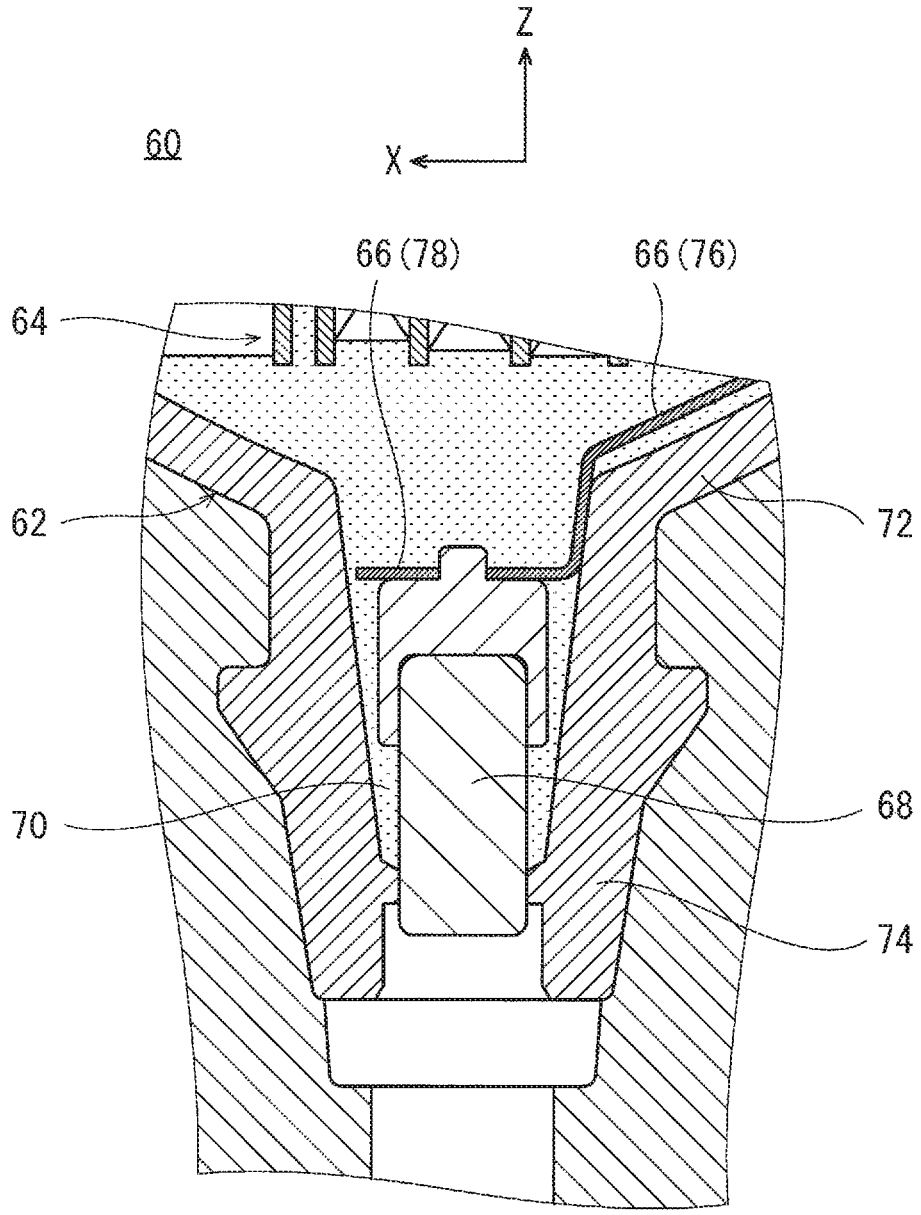
FIG. 5 is a sectional view of a part of an ignition coil according to another embodiment of the present invention.

FIG. 5 shows an ignition coil 60 according to another embodiment of the present invention. In FIG. 5, an arrow X indicates a frontward direction of the ignition coil 60. The direction opposite thereto is a rearward direction. An arrow Z indicates an upward direction of the ignition coil 60. The direction opposite thereto is a downward direction. The ignition coil 60 includes a case 62, a coil assembly 64, an igniter (not shown), a relay 66, a resistor 68, and a filler 70. FIG. 5 is an enlarged view showing the vicinity of an output portion 74 of the case 62. This ignition coil 60 is the same as the ignition coil 2 shown in FIGS. 1 to 3, except for the relay 66 and the resistor 68.

The relay 66 is stored in the case 62. The relay 66 extends from the inside of a body 72 of the case 62 to the inside of the output portion 74. The relay 66 is electrically connected to the output terminal of the coil assembly 64, and is also electrically connected to the resistor 68. The output terminal of the coil assembly 64 and the resistor 68 are electrically connected to each other via the relay 66. The relay 66 is made from a metal having excellent conductivity.

The resistor 68 is stored in the output portion 74 of the case 62. The resistor 68 has a bar shape. In the present embodiment, the resistor 68 has a columnar shape.

Figure 6:
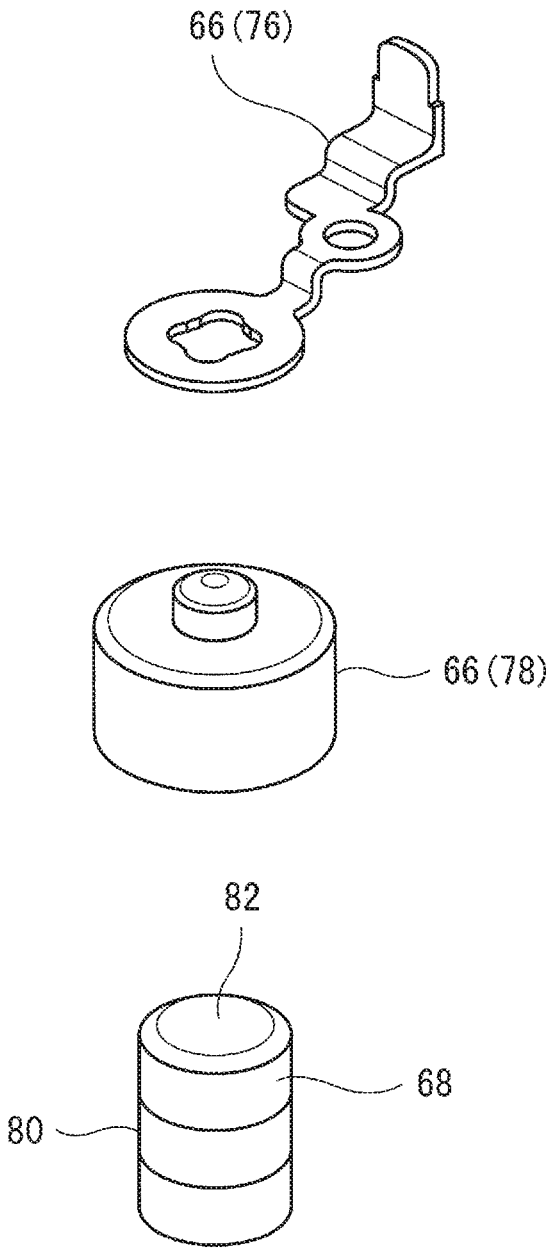
FIG. 6 is an exploded view showing a relay of the ignition coil shown in FIG. 5, together with a resistor.

FIG. 6 is an exploded view showing only the resistor 68 and the relay 66 shown in FIG. 5. As shown in FIG. 6, the relay 66 has an arm 76 and a connection portion 78 connected to one end of the arm 76. The other end of the arm 76 is in contact with the output terminal of the coil assembly. As shown in FIG. 6, a hole is formed in an end of the arm 76 on the connection portion 78 side. The connection portion 78 has a cap shape, and has a projection on the upper surface thereof. By inserting the projection of the connection portion 78 through the hole in the end of the arm 76, the connection portion 78 is attached to the arm 76. The resistor 68 is capped with the connection portion 78. Thus, the connection portion 78 comes into contact with a side surface 80 and an upper end surface 82 of the resistor 68.

In the present embodiment, the output terminal of the coil assembly, the arm 76 and the connection portion 78 are formed as separate components. The arm 76 may be formed integrally with the connection portion 78. The output terminal of the coil assembly may be formed integrally with the arm 76, and the connection portion 78 may be attached thereto. The output terminal of the coil assembly, the arm 76, and the connection portion 78 may be formed integrally with one another.

As described above, in the present embodiment, the connection portion 78 of the relay 66 has a cap shape, and the resistor 68 is capped with the connection portion 78. The connection portion 78 is in contact with the side surface 80 and the upper end surface 82 of the resistor 68. Thus, the relay 66 can be reliably fixed to the resistor 68, and further, the contact area between the connection portion 78 and the resistor 68 can be increased. This enables the contact resistance between the relay 66 and the resistor 68 to be stably reduced. This effectively prevents discharge at the resistor 68. In this ignition coil 60, electric noise due to discharge at the spark plug is effectively suppressed.

As described above, according to the present invention, it is possible to obtain an ignition coil that prevents discharge at a resistor with a simple structure while suppressing increase of components. Thus, advantages of the present invention are clear.

The ignition coil described above is applicable to various types of internal combustion engines.

The above descriptions are merely illustrative examples, and various modifications can be made without departing from the principles of the present invention.

What is claimed is:

1. An ignition coil for internal combustion engine, comprising:

a coil assembly including a primary coil, a secondary coil, and a terminal that outputs a voltage from the secondary coil;

a relay electrically connected to the terminal;

a resistor having a bar shape and electrically connected to the relay;

a case that stores the coil assembly, the relay, and the resistor; and a filler filling a gap inside the case, wherein the case includes a body, an output portion having a cylindrical shape and protruding from the body, and a holding portion which has an annular shape and which protrudes inward from an inner circumferential surface of the output portion and extends in a circumferential direction of the inner circumferential surface, the holding portion being formed integrally with the output portion, a part of the resistor is inserted into the holding portion, and thus a first internal area located on a body side with respect to the holding portion and shut off from outside is formed in an internal area of the output portion, and the filler fills the first internal area so as to cover a surface of the resistor, wherein a second internal area located on a side opposite to the body with respect to the holding portion is further formed in the internal area of the output portion, and the resistor penetrates through the holding portion, and thus one end of the resistor is located in the second internal area.

2. The ignition coil according to claim 1, wherein an outer diameter of the first internal area is larger than an outer diameter of the second internal area.

3. The ignition coil according to claim 1, wherein an outer diameter of the first internal area gradually decreases from the body side toward a holding portion side.

4. The ignition coil according to claim 1, wherein a side surface, of the holding portion, that is on the body side is sloped in an inward direction from the body side toward a side opposite thereto.

5. The ignition coil according to claim 1, wherein the relay is in contact with the resistor, in the first internal area.

6. The ignition coil according to claim 1, wherein the relay has a connection portion that is in contact with a side surface of the resistor.

7. The ignition coil according to claim 6, wherein the connection portion has a ring shape, and the resistor is inserted through an inner side of the connection portion.

8. The ignition coil according to claim 6, wherein the connection portion has a cap shape, and one end of the resistor is capped with the connection portion.

9. An ignition coil for internal combustion engine, comprising:

a coil assembly including a primary coil, a secondary coil, and a terminal that outputs a voltage from the secondary coil;

a relay electrically connected to the terminal;

a resistor having a bar shape and electrically connected to the relay;

a case that stores the coil assembly, the relay, and the resistor; and a filler filling a gap inside the case, wherein the case includes a body, an output portion having a cylindrical shape and protruding from the body, and a holding portion which has an annular shape and which protrudes inward from an inner circumferential surface of the output portion and extends continuously in a circumferential direction of the inner circumferential surface, the holding portion being formed integrally with the output portion, a part of the resistor is inserted into the holding portion, and thus a first internal area located on a body side with respect to the holding portion and shut off from outside is formed in an internal area of the output portion, and the filler fills the first internal area so as to cover a surface of the resistor, wherein a side surface of the resistor and the inner circumferential surface of the holding portion are in contact with each other without gaps.

10. The ignition coil according to claim 1, wherein the output portion includes a portion extending from the holding portion to a connecting portion of the resistor and the relay, forming at least part of the first internal area, said portion having a diameter gradually increased from the holding portion toward the connecting portion of the resistor and the relay.

11. The ignition coil according to claim 1, wherein the resistor includes an upper portion, a middle portion and a lower portion, an outer diameter of the upper portion being larger than an outer diameter of the middle portion, and the relay has a connection portion with a hole through which the upper portion of the resistor penetrates, such that the connection portion of the relay directly contacts a side surface of the upper portion of the resistor.

12. The ignition coil according to claim 1, wherein the relay has a through hole, and the resistor insert into the through hole so that a part of the resister projects from the relay to the body side.

13. The ignition coil according to claim 9, wherein the output portion includes a portion extending from the holding portion to a connecting portion of the resistor and the relay, forming at least part of the first internal area, said portion having a diameter gradually increased from the holding portion toward the connecting portion of the resistor and the relay.

14. The ignition coil according to claim 9, wherein the resistor includes an upper portion, a middle portion and a lower portion, an outer diameter of the upper portion being larger than an outer diameter of the middle portion, and the relay has a connection portion with a hole through which the upper portion of the resistor penetrates, such that the connection portion of the relay directly contacts a side surface of the upper portion of the resistor.

15. The ignition coil according to claim 9, wherein the relay has a through hole, and the resistor insert into the through hole so that a part of the resister projects from the relay to the body side.

* * * * *